United States Patent [19]

Dilo

[11] 4,378,618

[45] Apr. 5, 1983

[54] APPARATUS FOR PRODUCING VELOUR-NEEDLEFELT WEBS

[75] Inventor: Richard Dilo, Eberbach, Fed. Rep. of Germany

[73] Assignee: Oskar Dilo Maschinenfabrik KG, Fed. Rep. of Germany

[21] Appl. No.: 108,041

[22] Filed: Dec. 28, 1979

[30] Foreign Application Priority Data

Jan. 11, 1979 [DE] Fed. Rep. of Germany ..... 2900935

[51] Int. Cl.[3] ..... D04H 18/00; D04H 11/08

[52] U.S. Cl. ..... 28/110; 28/115

[58] Field of Search ..... 28/110, 111, 115

[56] References Cited

U.S. PATENT DOCUMENTS

| | | | |
|---|---|---|---|
| 3,530,557 | 9/1970 | Dilo | 28/110 |
| 3,758,926 | 9/1973 | Dilo | 28/110 |
| 4,035,881 | 7/1977 | Zocher | 28/111 |
| 4,085,486 | 4/1978 | Dilo | 28/110 |
| 4,138,772 | 2/1979 | Dilo | 28/110 |

FOREIGN PATENT DOCUMENTS

| | | | |
|---|---|---|---|
| 2265895 | 10/1975 | France | 28/115 |

*Primary Examiner*—Robert Mackey

*Attorney, Agent, or Firm*—McGlew & Tuttle

[57] ABSTRACT

The invention refers to a machine for the production of velour needlefelt webs through processing a fiber fleece bonded through needling, using velour or fork needles forming pile loops, wherein at least one fiber fleece band consisting of several layers is helically wound to form a tube continuously developing in axial direction, said tube rotating about its own axis, wherein the individual layers of the fleece band partly overlap on each wind and the lower or inner-lying layers of the wound tube are bonded in a width which is smaller, preferably up to half the width of the width of the fleece band in a known manner using felting needles and from the upper or outer-lying loose fiber layer of the wound tube, the fibers forming the pile loops are pushed through the pre-bonded lower or inner-lying fiber layer in a known manner using fork needles and wherein the finished processed tube is cut open in axial direction, laid flat and the so-formed material web wound up.

3 Claims, 4 Drawing Figures

APPARATUS FOR PRODUCING VELOUR-NEEDLEFELT WEBS

BACKGROUND OF THE INVENTION

The invention refers to apparatus for the production of velour needlefelt webs of material through processing, i.e. needle punching a fiber fleece with felting needles for the purpose of bonding said fleece and subsequently needle punching the pre-bonded fiber fleece using fork needles forming pile loops.

It is already known to produce velour needlefelt webs using needling techniques. Up to now it was done by building up or cutting a lengthwise orientated fiber fleece web delivered from a carding machine, in a zigzag manner using a cross layer to form a multi voluminous, transverse-orientated fiber fleece which is then subjected to further processing. The mentioned type of production of the fleece to be further processed causes an irregular build-up of the fleece, in particular an undesired increase in the thickness of the fleece in the edge region.

It is furthermore a disadvantage that when needling such a fleece, the thickness of the edge is further increased through the shrivelling of the material web, and this makes it necessary to cut the web causing a considerable amount of waste. The further processing of such a fleece is carried out in that said fiber fleece is needled for the purpose of bonding and subsequently the pile is formed using fork needles which push the pile loops out of the already relatively evenly bonded fiber fleece.

This mode of operation has several significant disadvantages, those concerning production as well as those regarding the quality of the end product.

As the fibers forming the pile loops have to be pushed out of the fiber fleece which has necessarily been bonded in its entire thickness, and as this fiber fleece has already undergone considerable compression, quite a considerable amount of work has to be performed in order to form the pile. This necessitates a high driving power of the machine as well as an extremely rigid machine design which is able to absorb the strong forces. As the end product is mainly for use as floor covering, the web must have a certain minimum width. The machine frame design must correspond to this width, so an enormous construction expense is inevitable with the common web widths, due to the required rigidity of the machine parts involved.

It is also a disadvantage that the machine output is limited as a result of heating-up of the tools and machine parts occurring due to the high rubbing effect during the needling of the fiber web, especially during the pile formation, said heating often having detrimental effects on the fiber material as well as on the machine itself.

Finally, regarding the end product, it is disadvantageous that according to the already known method only 25–30% of the fiber material can be pushed out of the pre-bonded fiber fleece to form the pile, and this results in a very poorly formed fabric due to too low a pile density, and this enables only a very limited use.

A machine or unit for producing such velour needlefelt webs consists of the carding unit, the transverse or cross layer, a preneedling machine and a main needling machine, a velour needling machine and the necessary devices for the subsequent treatment of the mechanically processed web. This list clearly shows the hitherto considerable expenditure of apparatus, wherein it must be considered that the individual machines or devices must be of a width corresponding to that of the material web.

SUMMARY OF THE INVENTION

The invention is based on the task of providing apparatus which enables the production of a high quality velour needlefelt material which is in no way inferior to the velour material produced with other methods and, as opposed to the hitherto known velour needlefelt material, has a considerably more favorable fiber distribution regarding the pile and bottom material, and which can be carried out with a considerably lower expenditure of costs for the apparatus. Preferably, in the most favorable case, it should be possible that up to 70% of the fibers of the fiber web lie in the pile material and only 30% in the bottom material. Such a web is similar to all other velour material webs and is able to compete with them regarding the quality of the product.

For solving the given task, it is suggested according to the invention, for the production of velour needlefelt webs, that at first at least one fiber fleece band consisting of several layers is helically wound to form a tube continuously developing in the axial direction, said tube rotating about its own axis, wherein the individual layers of the fiber fleece band partly overlap on each wind, that then the lower or inner lying layer of the wound tube is bonded in a width smaller, preferably about half of the width of the fiber fleece band itself in a per se known manner with felting needles and that then, from the upper or outer lying loose fiber layer of the wound tube, the pileforming fibers are pushed through the pre-bonded lower or innerlying fiber layer also in a known manner, using fork needles.

In order to achieve an evenly-thick and homogenous fiber fleece, wound as a tube, the individual layers of a fiber fleece band are staggered in relation to each other and superposed in the opposite direction to that of the direction of motion of the tube. On winding of the tube of the so-formed fiber fleece band the individual layers are laid up at an acute angle relative to the cylindrical supporting surface of the tube.

The lateral displacement of the layers when building up the fiber fleece band, must be of the size that the inclined edge of the fleece band lies basically parallel to the supporting surface for the tube upon the formation thereof, or rather the edge attaches on to the slanted edge of the previous wind.

The tube formed and processed in the described manner, the outside of which is treated and processed in the usual manner or which can have a coating material applied to it, is then cut open in dependence of its rotation so that a web is formed with parallel edges which is then laid flat and rolled up.

The suggested method according to the invention has the substantial advantage that the fiber material wound to form a tube is only bonded to a certain height for the purpose of forming the bottom and that the loose fiber material situated above this pre-bonded and sufficiently dense fiber layer, is mainly pressed through the pre-bonded layer for the formation of the pile. The area in which the fleece wound to form a tube is processed can be relatively small, as due to the winding of the tube with simultaneous axial movement, a sufficient processing of the fiber material takes place, and this requires a relatively low expenditure of apparatus costs and a considerably simpler machine design.

The machine for carrying out the method according to the invention has a shaft arranged standfest to a frame, said shaft having a lamella strip helically wound thereon and secured thereto with an even, constant pitch, opposite to which is arranged at least one needle beam equipped with felting and fork needles which can move radially towards the shaft. A fiber fleece band feeding means and at least one tube turning and feeding means consisting of an endless conveyor belt are associated with the shaft formed in the aforementioned manner, in the area of the working area of the needles of the needle beam. The endless belt of the tube rotating and feed means is passed over at least 2 deflecting rolls, wherein half of said belt lies under tension force against the outside of the tube so that when the belt is moved, the tube follows the motion due to the prevailing friction between said tube and belt and is thus rotated.

Advantageously, there are two needle beams associated with the shaft with the lamella plate, so that two fiber fleece bands can also be fed in for the forming of the tube, and thus increase the efficiency of the machine.

BRIEF DESCRIPTION OF THE DRAWINGS

Further features and details of the machine formed according to the invention can be seen from the following description of a preferred embodiment which is shown in FIGS. 1 to 4.

DETAILED DESCRIPTION OF THE DRAWINGS

Figure 1:
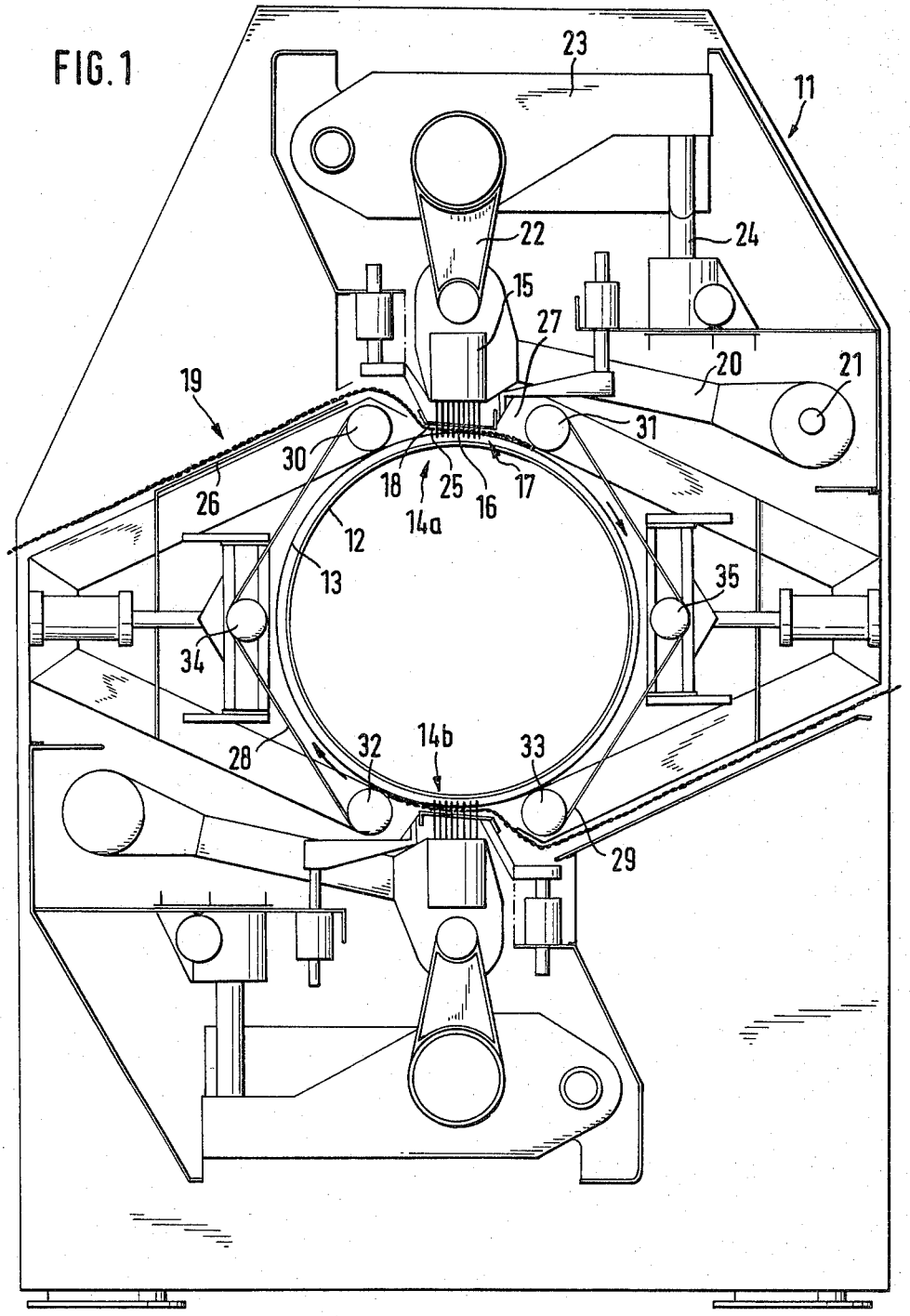
FIG. 1 shows a cross section of the machine, seen schematically.

As FIG. 1 shows, a tube-shaped shaft 12 is, in this case, horizontally fixed to a frame of the machine 11 not shown in detail. On the outer circumference of the shaft 12, a lamella plate 13 consisting of a steel fillet is helically wound and adhered, with a pitch corresponding to the spacing of the needles in the needle beam. Above and below the shaft 12 are situated the upper and lower needle stations 14*a* and 14*b* respectively, which are basically the same in structure and therefore only the upper needle station 14*a* will be described in detail. The needle beam 15, extending over a certain length of the shaft 12, carries two groups of needles arranged in tandem in longitudinal direction of the shaft 12, these being the felting needles 16 and behind these the velour or fork needles 17. The needles 16 and 17 are passed through openings in the hold-down plate 18, the fiber fleece band being fed in between the hold-down plate 18 and the lamella plate 13. The needle beam is supported by one or more arms 20 mounted on an axle 21. A connecting rod 22, the mounting lever 23 and an oscillatable push or draw-bar 24 are responsible for setting the needle beam in up and downwards motion, wherein the free ends of the needles penetrate through the layered fleece 25 situated above the lamellae 13 of the shaft 12 in a known manner and bond the area of the fleece 25 adjacent to the lamellae 13 on the one hand and push the fibers from the outer lying loose layer of the fleece through the bonded base layer to form the pile loops.

The fiber fleece band belt 19 is fed in to the needle stations 14 via the guide plate 26. The feed speed of the fiber fleece band belt 19 is synchronous to the rotating speed of the fiber material tube 27 formed about the shaft 12 with its lamellae 13, said tube being constantly, evenly turned with the aid of the tube-turning device. This consists of the two endless belts 28,29 which are displaced via the two upper rolls 30, 31 or lower rolls 32, 33, respectively and brought under tension via the middle rolls 34 or 35, respectively and lie against the fiber material tube 27 under corresponding initial tension and press it against the lamella plate 13 and due to the friction, drive the tube 27 in correspondence to their own movement. As the lamellae are made up from a spiral-wound fillet and in the second part of the needle station 14 the pile loops are pushed between two adjacent lamellae respectively, the fiber material tube 27 is automatically moved axially with corresponding rotation in correspondence with the pitch of the lamella plate 13.

Figure 2:
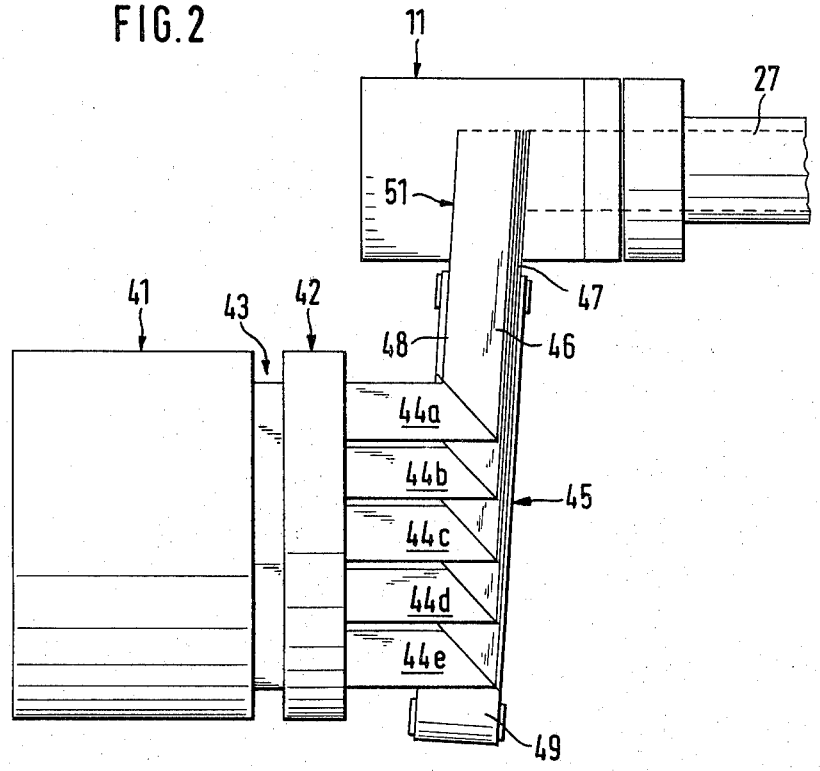
FIG. 2 shows a top view of the schematically shown machine.

As FIG. 2 shows, a carding machine 41 with a web divider 42 is associated with the previously described machine 11, said web divider 42 dividing the web 43 coming from the carding machine into strips 44*a* to 44*e*. The web strip layering device 45 diverts the web strips 44*a* to 44*e* in the shown manner and lays them on each other in such a way that each web strip lying over the lower web strip is in staggered arrangement to said lower strip so that the so formed fiber fleece band 46 consists of five layers staggered in relation to each other, said layers having a reduced edge area 47 or 48 repectively as can be seen from FIG. 3.

Figure 3:
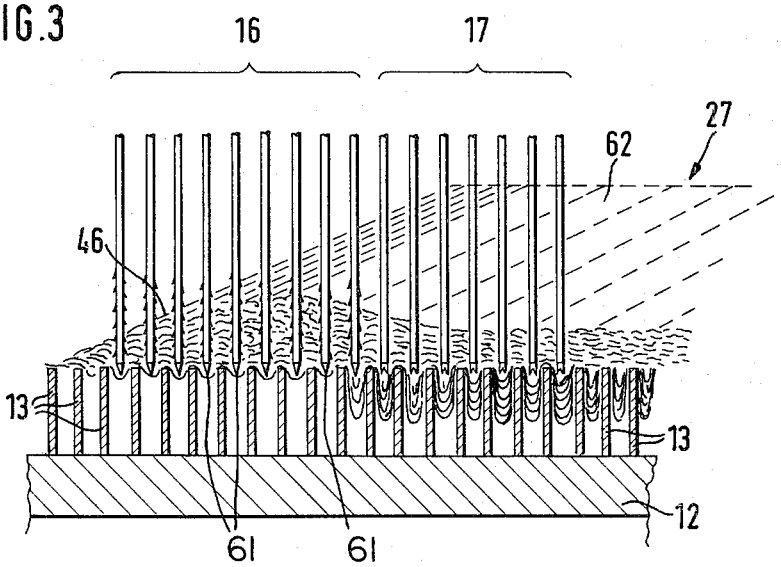
FIG. 3 shows a cross section through a part of the fiber material of several inclined superposed layers from which the fiber material tube is formed.

The web strips 44*a* to 44*e* or rather the fleece band 46 fromed therefrom is laid up on the conveyor belt 49 which leads it to the fleece band feed and guide device 51 which ensures that the fiber fleece 46 is laid up in layers in the manner for the formation of the fiber material tube 27, that the individual layers of the fiber fleece band 46 lie inclined at an acute angle and that an evenly high fiber material layer is maintained with even, homogeneous fiber distribution, as can be seen from FIG. 3 which schematically shows the layer formation of the fiber material tube 27. Through this type of structure of the fiber material to be needled and through the arrangement of the needle zones in the area of the infeed of the fiber fleece band 46 in the machine 11, it is achieved that the needles of the needle group 16 serving the pre-bonding of the bottom layer 61 only grasp the lower or rather inner layer 61 and not the fibers lying in the top or outer loose layer 62 which, on entry of the fleece band 46 and during development of the tube 27 are caught by the velour or fork needles of the needle group 17 and pushed through the lower or inner layer 61 into the spaces between the individual lamellae 13 to form the pile loops.

That shown in FIG. 3 is only schematic in as far as in the area of the needles and behind the needles, the fiber material of the tube 27 actually takes on a different form, i.e. the surface sinks and the material width becomes less, as on the one hand it has been bonded and on the other hand the fibers have been pushed through the bonded layer as pile loops. FIG. 3 is mainly to show the theoretical structure of the fiber material from which the fiber material tube 27 is formed.

Figure 4:
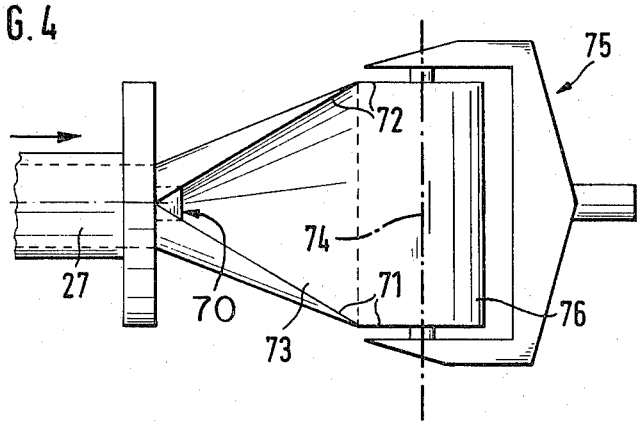
FIG. 4 shows a top view of the cutting and winding appliance succeeding the machine.

The tube 27 formed in the aforementioned manner is, as shown in FIG. 4, either immediately cut after the formation thereof with a cutting device 70, or possibly after subsequent treatment of its outside, e.g. through application of a coating in a known manner, said cutting device 70 being rotatably mounted and synchronously turned with the tube, in order to achieve parallel edges 71, 72, of the flat velour needlefelt web 73. The web 73 is then rolled up to a bale 76 with the aid of the winding device 75 rotatable about the tube axis 74.

What I claim is:

1. A machine for the production of velour needlefelt webs in the form of a tube, said machine comprising a frame, a shaft mounted in said frame, a lamella plate helically wound and coupled to said shaft and having a constant pitch, said plate being associated with at least one needle beam equipped with felting and fork needles which can be radially moved towards the shaft, at least one fleece band feeding means and at least one tube turning and feeding means comprising endless belt means associated with said shaft in the working area of the needles of said needle beam.

2. The machine according to claim 1, wherein there are two of said needle beams associated with said shaft and a tube turning means and a fleece band feeding means associated with each said needle beam.

3. The machine according to claim 2, wherein said two needle beams are located 180° apart.

* * * * *